US009216877B2

(12) United States Patent
Grünwald et al.

(10) Patent No.: US 9,216,877 B2
(45) Date of Patent: Dec. 22, 2015

(54) FOLDING AND STACKING INSTALLATION FOR WEBS OF CORRUGATED CARDBOARD

(75) Inventors: Gerhard Grünwald, Freudenberg (DE); Markus Fischer, Mantel (DE)

(73) Assignee: BHS Corrugated Maschinen—und Anlagenbau GmbH, Weiherhammer (DE)

( * ) Notice: Subject to any disclaimer, the term of this patent is extended or adjusted under 35 U.S.C. 154(b) by 924 days.

(21) Appl. No.: 13/182,793

(22) Filed: Jul. 14, 2011

(65) Prior Publication Data

US 2012/0021886 A1 Jan. 26, 2012

(30) Foreign Application Priority Data

Jul. 22, 2010 (DE) ..... 10 2010 031 668

(51) Int. Cl.

| | |
|---|---|
| ***B65H 45/30*** | (2006.01) |
| ***B65H 45/101*** | (2006.01) |
| *B65H 45/20* | (2006.01) |
| *B65H 45/00* | (2006.01) |

(52) U.S. Cl.

CPC ..... *B65H 45/1015* (2013.01); *B65H 45/00* (2013.01); *B65H 45/20* (2013.01)

(58) Field of Classification Search

CPC ..... B65H 45/00; B65H 45/12; B65H 45/06; B65H 45/09; B65H 45/142; B65H 45/148; B65H 45/16; B65H 45/164; B65H 45/20; B65H 45/30; B65H 45/203; B31F 1/00

USPC ..... 493/411, 448, 441, 451, 463, 356, 405, 493/408–410, 413, 421–433, 454, 359

See application file for complete search history.

(56) References Cited

U.S. PATENT DOCUMENTS

| | | | |
|---|---|---|---|
| 2,604,984 | A | 7/1952 | Apgar |
| 4,210,318 | A | 7/1980 | Mehren |

(Continued)

FOREIGN PATENT DOCUMENTS

| | | | |
|---|---|---|---|
| DE | 103 06 212 | A1 | 8/2004 |
| DE | 10306212 | A1 | 8/2004 |
| DE | 103 12 600 | A1 | 10/2004 |

OTHER PUBLICATIONS

Search report in corresponding European application dated Oct. 31, 2011.

*Primary Examiner* — Andrew M Tecco
*Assistant Examiner* — Chelsea Stinson
(74) *Attorney, Agent, or Firm* — Browdy and Neimark, PLLC

(57) ABSTRACT

An installation for folding and stacking an endless web of corrugated cardboard comprises at least one corrugated cardboard production device for producing an endless web of corrugated cardboard, a squeezing device which is arranged downstream of the at least one corrugated cardboard production device for embossing folds into the web of corrugated cardboard, and a folding device which is arranged downstream of the at least one squeezing device for folding the web of corrugated cardboard along the folds. The folding device has a first engagement member which is guided for displacement so as to carry along the web of corrugated cardboard in the region of a first fold and at least one second engagement member which is guided for displacement independently of the first engagement member so as to carry along the web of corrugated cardboard in the region of a second fold which is arranged upstream of the first fold. Furthermore, the installation comprises a stacking device which is arranged downstream of the folding device for stacking the web of corrugated cardboard, which has been folded along the folds, in such a way as to form stacks.

16 Claims, 5 Drawing Sheets

(56) References Cited

U.S. PATENT DOCUMENTS

| | | | | |
|---|---|---|---|---|
| 5,058,872 | A | 10/1991 | Gladow | |
| 6,071,223 | A * | 6/2000 | Reider et al. | 493/410 |
| 7,008,364 | B2 * | 3/2006 | Ochsenbauer | 493/427 |
| 8,834,336 | B2 * | 9/2014 | Grill | 493/359 |
| 2004/0182503 | A1 | 9/2004 | Stadele | |
| 2004/0229741 | A1 * | 11/2004 | Nelles et al. | 493/413 |

* cited by examiner

FOLDING AND STACKING INSTALLATION FOR WEBS OF CORRUGATED CARDBOARD

CROSS-REFERENCE TO RELATED APPLICATIONS

This application claims the priority of German Patent Application, Serial No. DE 10 2010 031 668.7 filed on Jul. 22, 2010, pursuant to 35 U.S.C. 119(a)-(d), the content of which is incorporated herein by reference in its entirety as if fully set forth herein.

BACKGROUND OF THE INVENTION

1. Field of the Invention

The invention relates to an installation and a device for folding and stacking webs of corrugated cardboard. The invention is not restricted to the use of webs of corrugated cardboard.

2. Background Art

DE 103 06 212 A1 discloses a method and a device for folding endless webs of corrugated cardboard. There is provided a drive device which consists of two synchronously moved conveyor belts which are arranged on both sides of the web of corrugated cardboard and between which several ropes are stretched. The ropes engage with folds in the web of corrugated cardboard and deposit the web of corrugated cardboard, which is folded in the manner of a Leporello, in such a way as to form a stack. One drawback of the known device is that the webs can only be folded to a predetermined size.

It is an aspect of the invention to provide an installation and a method which facilitate the processes of the folding and stacking endless webs of corrugated cardboard in the event of a change in size. Another aspect of the invention is to provide an installation and a method which are adaptable to different sizes as easily as possible. A continuous size adjustment is preferred.

This aspect is achieved by the features of an installation for folding and stacking an endless web of corrugated cardboard, the installation comprising at least one corrugated cardboard production device for producing an endless web of corrugated cardboard; a squeezing device which is arranged downstream of the at least one corrugated cardboard production device for embossing folds into the web of corrugated cardboard; a folding device which is arranged downstream of the at least one squeezing device for folding the web of corrugated cardboard along the folds, with the folding device comprising a first engagement member which is guided for displacement so as to carry along the web of corrugated cardboard in the region of a first fold; and at least one second engagement member which is guided for displacement independently of the first engagement member so as to carry along the web of corrugated cardboard in the region of a second fold which is arranged upstream of the first fold; and a stacking device which is arranged downstream of the folding device for stacking the web of corrugated cardboard, which has been folded along the folds, in such a way as to form stacks.

Furthermore, this aspect is achieved by a method for folding and stacking an endless web of corrugated cardboard, the method comprising the following steps: producing an endless web of corrugated cardboard; embossing folds into the web of corrugated cardboard; folding the web of corrugated cardboard along the folds by means of a first engagement member which is guided for displacement so as to carry along the web of corrugated cardboard in the region of a first fold; and at least one second engagement member which is guided for displacement independently of the first engagement member so as to carry along the web of corrugated cardboard in the region of a second fold which is arranged upstream of the first fold; and stacking of the folded web of corrugated cardboard in such a way that stacks are formed.

The gist of the invention is that the engagement members are guided in the folding device independently of each other. The engagement members are preferably drivable individually, in other words independently of each other. Their speeds can advantageously be increased or reduced individually. The independent guidance of the engagement members facilitates a change in size. In the event of a change in size, it is therefore easily possible to change the distance of the engagement members relative to each other. The distance between the engagement members is thus easily adaptable to a changed distance of folds in the web of corrugated cardboard. In order to perform a change in size, the engagement members perform a relative movement relative to each other. There are provided at least two, preferably at least three, more preferably four and most preferably five engagement members. Advantageously, there is provided a maximum of seven engagement members. The engagement members may be oblong members. They are preferably chains, strings, ropes, rods, belts, wires or the like. The chains, strings, ropes, belts or wires are then stretched.

The guide device for guiding the engagement members ensures a secure and precise guidance of the engagement members. The guide device defines a movement path or trajectory for the engagement members.

The at least first circulatory member, which is guided by the guide device and to which the first engagement member is mounted, ensures a fail-safe and targeted displacement of the first engagement member. There may be provided exactly one first circulatory member. There may however also be provided several, preferably two, first circulatory members which then form a circulatory member unit or a pair of circulatory members. The first circulatory members move in a preferably synchronous manner.

The at least second circulatory member, which is guided by the guide device and to which the second engagement member is mounted, on the other hand ensures a fail-safe and targeted displacement of the at least second engagement member. There may be provided exactly one second circulatory member. There may however also be provided several, preferably two, second circulatory members which then form a circulatory member unit or a pair of circulatory members. The second circulatory members move in a preferably synchronous manner.

There are preferably provided several, in particular five, pairs of circulatory members. The circulatory members of a pair of circulatory members are preferably coupled with each other by means of the associated engagement member. They run synchronously.

The circulatory members are preferably endless members. They are in particular flexible or bendable. The circulatory members may be tapes, belts, ropes, strings, chains or toothed belts. The circulatory members assigned to the various engagement members are movable independently of each other.

The design in which the circulatory members are arranged next to one another in the guide device results in a guide unit which is extremely space-saving and therefore producible in a cost-effective manner.

The independent drive ensures that the first circulatory member and the at least second circulatory member are drivable independently of each other. The circulatory members are preferably provided with their own, independent drives.

Alternatively, a mechanical synchronization of pairs of circulatory members is conceivable.

The upwardly sloping lifting portion in which the circulatory members are guided upwards for lifting the web of corrugated cardboard causes the web of corrugated cardboard to be lifted in a fail-safe and targeted manner. In the lifting portion, the web of corrugated cardboard is lifted in the transport direction by the upward movement of the circulatory members, which therefore also causes the engagement members to be lifted accordingly. The engagement members are in engagement with the web of corrugated cardboard so as to carry along the web of corrugated cardboard. In the lifting portion, the web of corrugated cardboard is thus deflected upwards and away from its original path.

In the deposition portion, which is arranged downstream of the lifting portion and in which the circulatory members are guided downwards for folded deposition of the web of corrugated cardboard, the web of corrugated cardboard is folded in a simple and fail-safe manner. The web of corrugated cardboard is lowered down in the transport direction by the downward movement of the circulatory members in the deposition portion, which causes the engagement members to be lowered down accordingly as well. The engagement members are in engagement with the web of corrugated cardboard so as to carry along the web of corrugated cardboard. The web of corrugated cardboard is thus preferably lowered down again in the deposition portion. The deposition portion is preferably in the shape of an arc, more preferably in the shape of a circular arc. It is preferably in the shape of a quarter of a circular arc.

The return portion for returning the engagement members, which return portion is arranged downstream of the deposition portion and adjoins the inlet end of the lifting portion, ensures an easy return of the engagement members.

The circulatory members are guided along the lifting portion, the deposition portion and the return portion. The lifting portion, the deposition portion, and the return portion thus determine the movement path, in other words the trajectory of the circulatory members and therefore of the engagement members. Consequently, the movement path is preferably a closed-loop, in other words endless path.

The deposition support member on the one hand ensures optimum guidance of the free folds. On the other hand, it assists in the folding and deposition of the web of corrugated cardboard. The deposition support member, which is preferably in the shape of a star, is drivable for rotation and comprises at least two deposition support arms for interaction with unguided fold edge regions of the web of corrugated cardboard. The free folds are opposite to the folds which are carried along by the engagement members. This allows malfunctions of the installation to be effectively prevented.

The lifting table, which forms part of the stacking device, ensures a particularly simple and safe support of the stacks. It is adaptable to the height of the respective stack.

The design which comprises a separation device for separating the web of corrugated cardboard, the separation device being arranged between the folding device and the stacking device, allows the folded web of corrugated cardboard to be separated mechanically. The separation preferably occurs in the region of a fold. It is advantageous if a separation occurs during a change in size.

The at least one separation knife and the at least one counter member provided for interaction with the at least one separation knife allow the web of corrugated cardboard to be cut precisely and quickly. The at least one counter member forms a kind of a counter bearing for the at least one separation knife. Moreover, the at least one separation knife is able to penetrate into the counter member. To this end, the counter member preferably comprises a corresponding penetration recess for at least partially receiving the at least one separation knife. It is advantageous if the penetration recess is a groove. The penetration recess is preferably open with respect to the at least one separation knife. In order to cut the web of corrugated cardboard, the at least one separation knife can be guided along the fold where the separation is supposed to be performed. The separation knife is preferably a circular knife. Other shapes or designs of the knife are conceivable.

The separation knife and the counter member are movable relative to each other, in other words they are movable towards each other for separating the web of corrugated cardboard. They are therefore movable between a closed separation position and an open non-separation position.

The following is a description of a preferred embodiment of the invention with reference to the enclosed drawing.

DESCRIPTION OF THE PREFERRED EMBODIMENT

Figure 1:
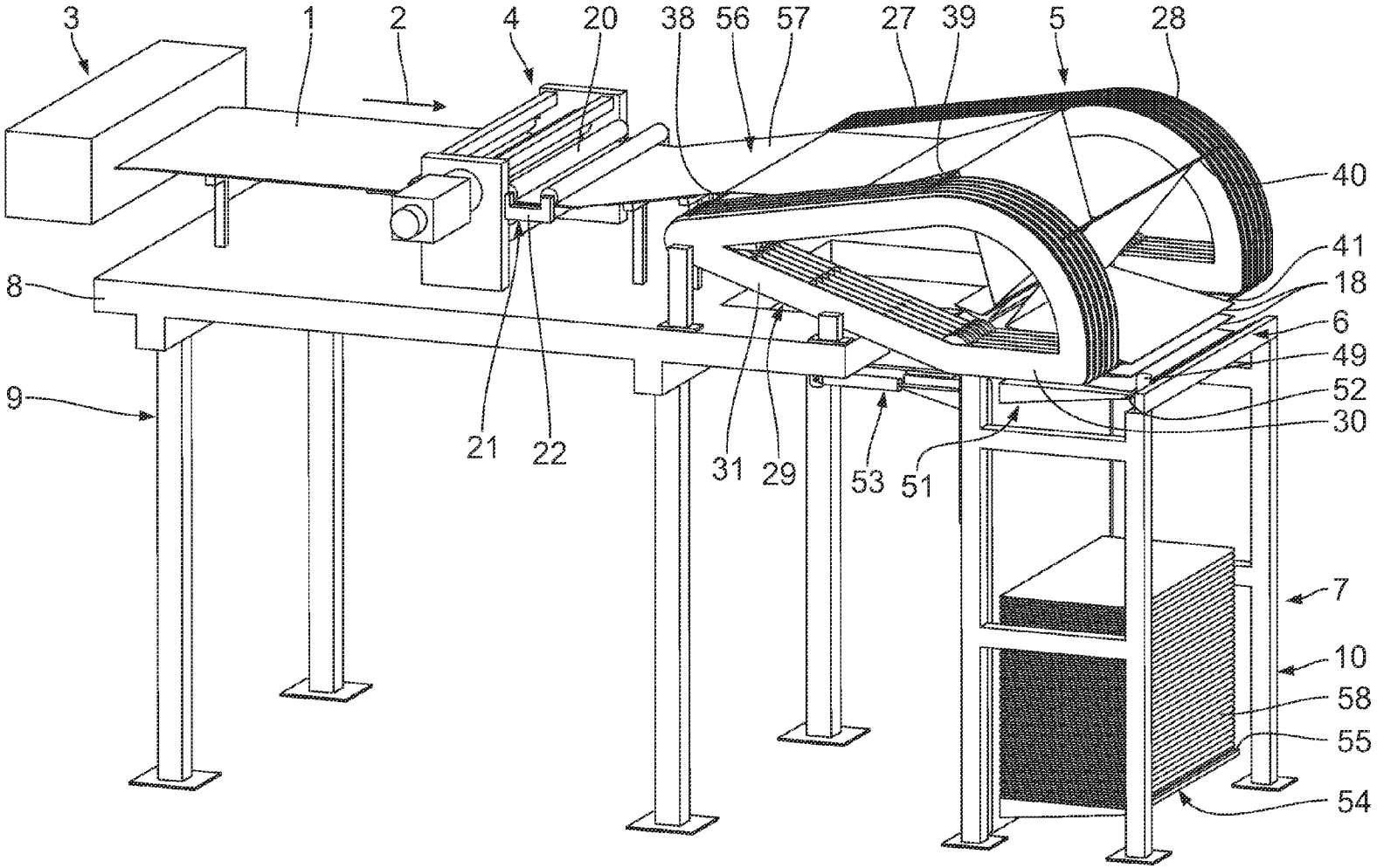
FIG. 1 is a perspective view of an installation according to the invention.
Figure 2:
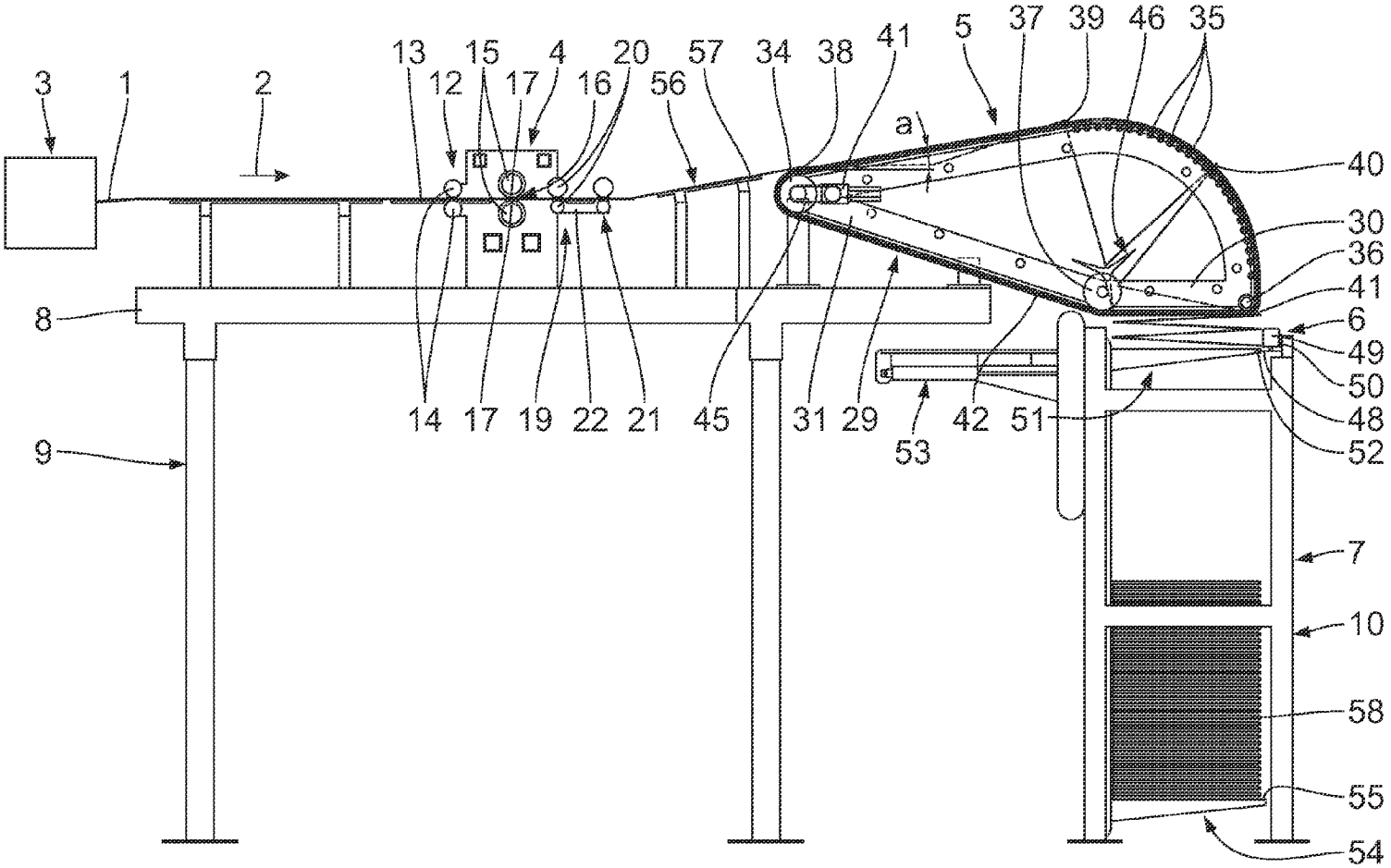
FIG. 2 is a side view of the installation shown in FIG. 1.
Figure 3:
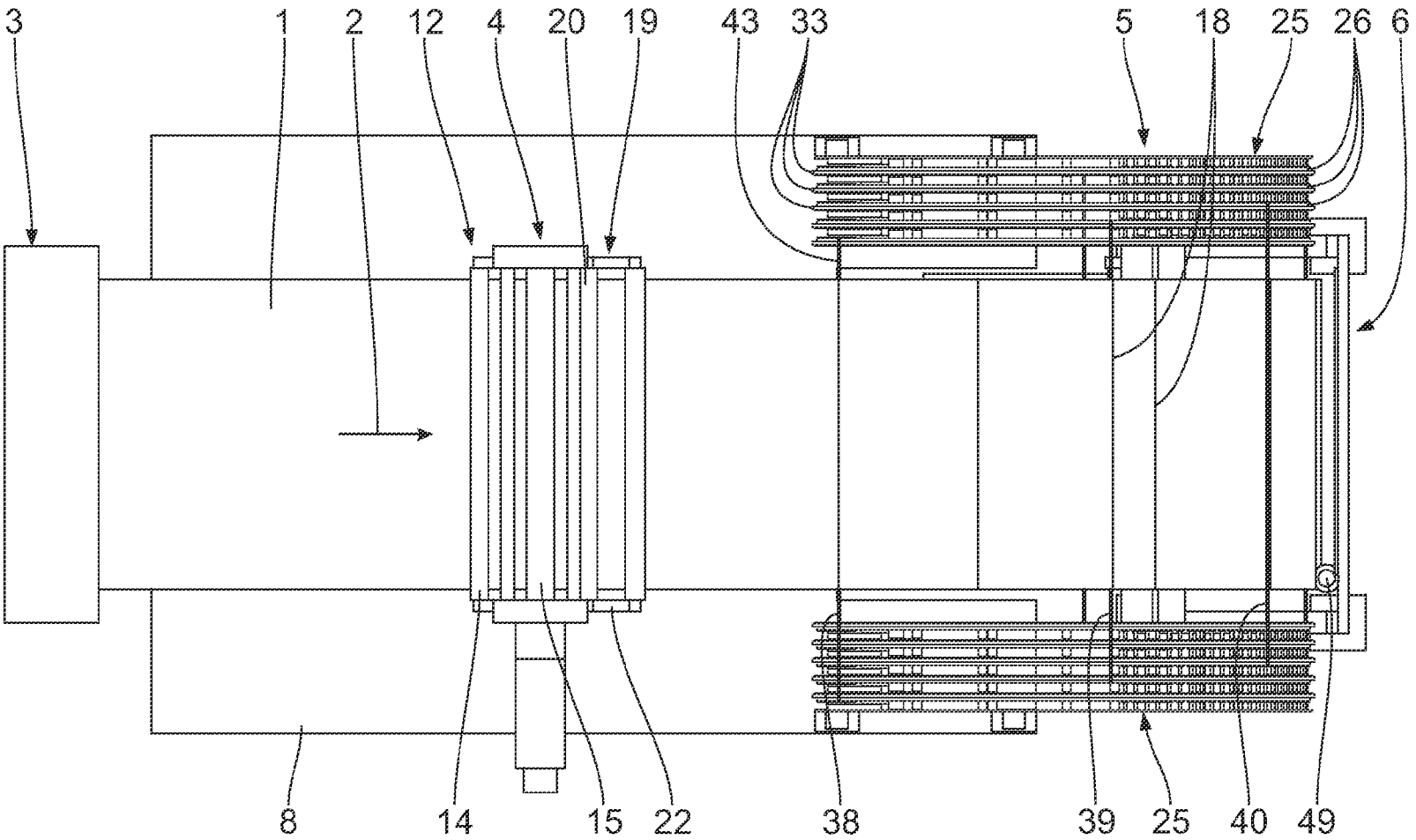
FIG. 3 is a plan view of the installation shown in FIGS. 1 and 2.
Figure 4:
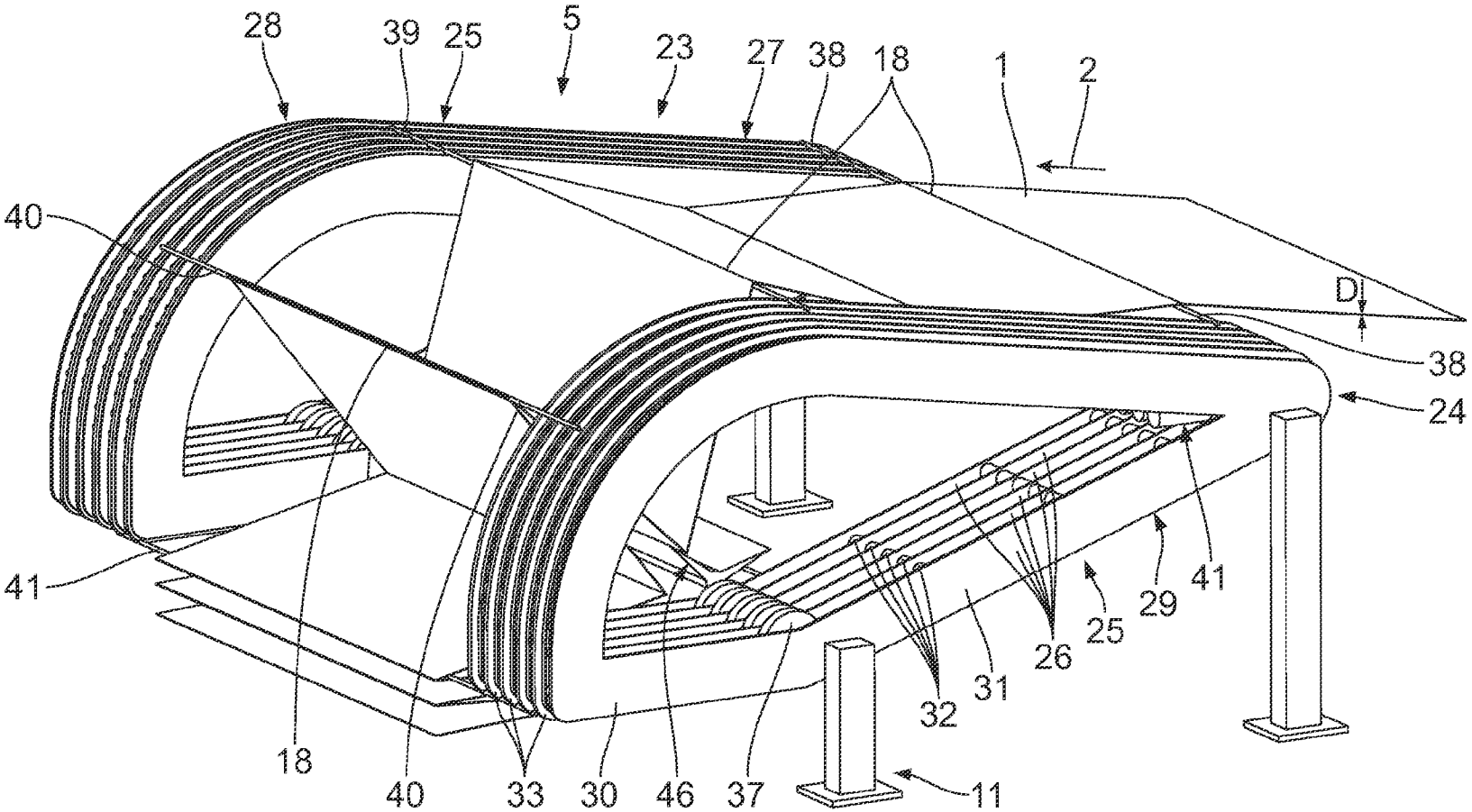
FIG. 4 is an enlarged perspective view of the folding device shown in FIGS. 1 to 3.
Figure 5:
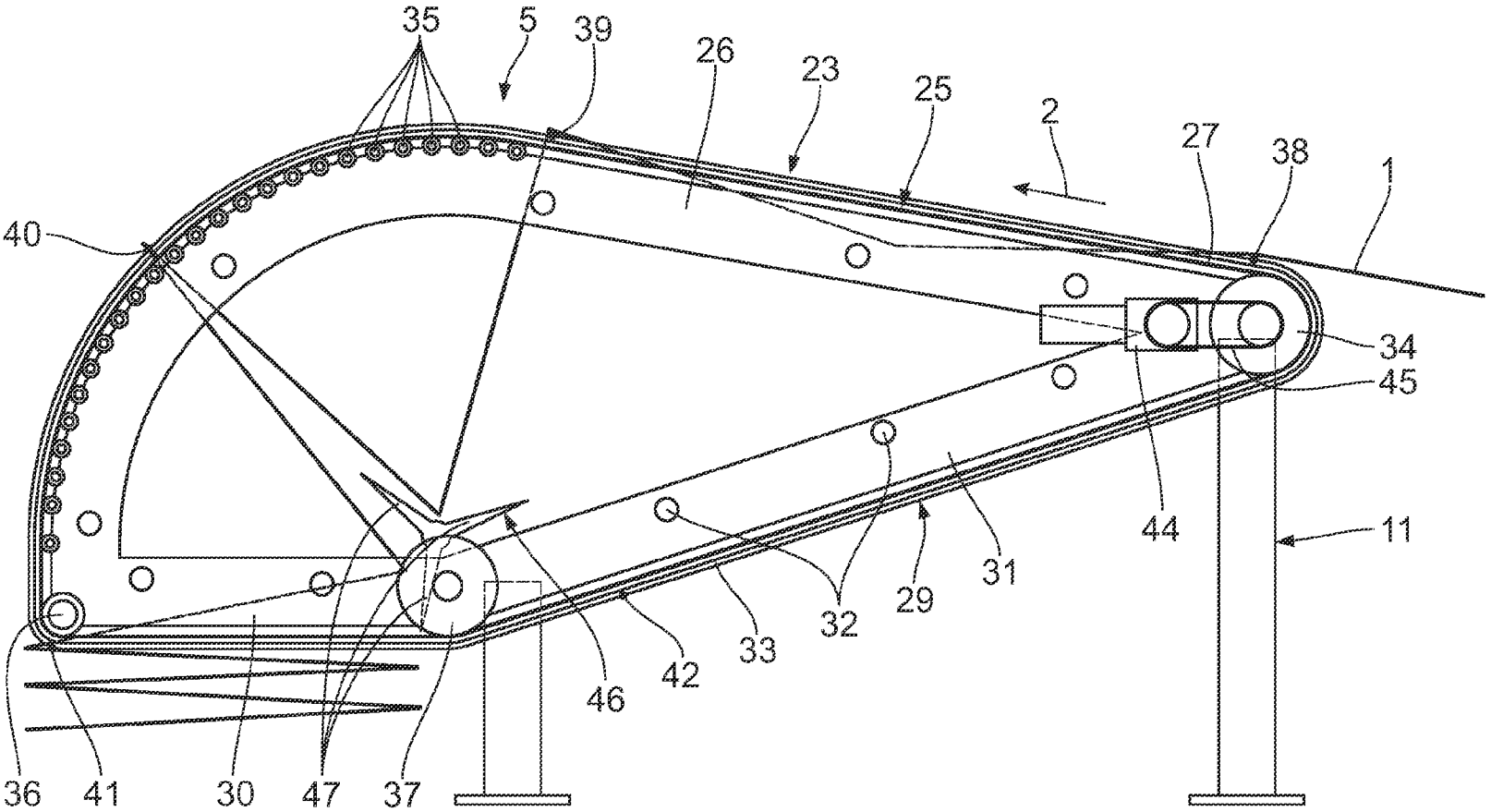
FIG. 5 is a side view of the folding devices shown in FIG. 4.

An installation for folding and stacking an endless web 1 of corrugated cardboard is only schematically shown in FIGS. 1 to 3. In the installation, the web 1 of corrugated cardboard is substantially transported in a transport direction 2. The installation comprises a corrugated cardboard production device 3. A corrugated cardboard production device 3 of this type is used for the production of the web 1 of corrugated cardboard and is for example disclosed in DE 103 12 600 A1 to which reference is made. The endless web 1 of corrugated cardboard which is producible by means of the corrugated cardboard production device 3 may have an essentially random number of layers. The web 1 of corrugated cardboard has a total thickness D.

In addition to the corrugated cardboard production device 3, the installation further comprises a squeezing device 4, a folding device 5, a separation device 6 and a stacking device 7. The squeezing device 4 is arranged downstream of the corrugated cardboard production device 3 while the folding device 5 is provided downstream of the squeezing device 4. The separation device 6 is in turn arranged downstream of the folding device 5. The stacking device 7 is arranged downstream of the separation device 6.

The squeezing device 4 is arranged on a first platform 8 which is rigidly connected to the floor via a first frame 9. The stacking device 7 is rigidly connected to the floor via a second frame 10. The separation device 6 is mounted to the second frame 10 as well. The folding device 5 is connected to the first frame 9 and/or to the second frame 10 via a third frame 11. The frames 9, 10, 11 together form a support scaffolding for the installation. The support scaffolding provides for a flexible, modular design of the installation.

The following is a more detailed description of the squeezing device 4. The squeezing device 4 comprises an inlet portion 12 with a support surface 13. In the region of the inlet portion 12, two inlet rollers 14 are arranged. The inlet rollers 14 are cylindrical and are in each case rotatable about an inlet roller axis which is perpendicular or substantially perpendicular to the transport direction 2. The inlet rollers 14 may in particular be drivable for rotation.

The squeezing device 4 further comprises at least one pair of embossing rollers 15 which are in each case rotatable about an embossing roller axis. The embossing rollers 15 are preferably drivable for rotation by means of a drive device which is not shown in the Figures. The drive is advantageosly actuated at regular intervals. The embossing roller axes are parallel to each other and perpendicular or substantially perpendicular to the transport device 2. Like the inlet roller axes, they are arranged vertically above one another. The distance between the embossing roller axes is adjustable. Between the surfaces of the embossing rollers 15, there is a passage gap 16 with a free opening. The free opening of the passage gap 16 is at least equal to the thickness D of the web 1 of corrugated cardboard. It is preferably adapted to the thickness D of the web of corrugated cardboard in such a way that the embossing rollers 15 are in frictional contact with the web 1 of corrugated cardboard while allowing the web 1 of corrugated cardboard to pass through the embossing rollers 15 without deformation. The two embossing rollers 15 are at least essentially identical. They have a circumference in the range of 80 cm to 140 cm.

The surface of each embossing roller 15 is provided with at least one embossing member 17. The embossing member 17 is in the shape of a beam and blunt. It has an extension in the radial direction of the respective embossing roller 15, in other words perpendicular to the surface of the respective embossing roller 15, which is smaller than half of the free opening. The embossing member 17 is continuous. It is however also conceivable for the embossing member 17 to be in the shape of a rake, in other words to have an interrupted shape. The embossing members 17 are arranged on the circumference of the embossing rollers 15 in such a way that they meet each other during each revolution of the embossing rollers 15 about the embossing roller axes. When the embossing members 17 meet each other, the free opening of the passage gap 16 is reduced to a value which is smaller than the thickness D of the web 1 of corrugated cardboard. The web 1 of corrugated cardboard is thus squeezable by means of the embossing members 17. According to FIG. 2, the embossing members 17 are just located in the passage gap 16. In said passage gap 16, they are opposite to each other. The embossing members 17 are preferably parallel to the embossing roller axes so as to provide the web 1 of corrugated cardboard with folds 18 which are perpendicular or substantially perpendicular to the transport direction 2 and therefore also perpendicular or substantially perpendicular to the longitudinal direction of the web of corrugated cardboard. The distance between two succeeding folds 18 in one embodiment just corresponds to the circumference of the embossing rollers 15. The folds 18 form predetermined folding points in the web 1 of corrugated cardboard along which the web 1 of corrugated cardboard is particularly easily foldable. The web 1 of corrugated cardboard has a lower thickness in the region of the folds 18 and therefore a lower bending elasticity than in the region beyond the folds 18. Folding of the web 1 of corrugated cardboard is thus particularly easy in the region of the folds 18.

Alternatively, it is conceivable to provide only one of the embossing rollers 15 with an embossing member 17. In this case, the circumference of the embossing roller 15 without embossing member 17 need not fulfil any particular requirements. The circumference is substantially randomly selectable and may in particular be different from the circumference of the embossing roller 15 having an embossing member 17. In another embodiment, embossing rollers 15 are provided whose circumference just corresponds to an integral multiple of the desired distance between two adjacent folds 18 in the web 1 of corrugated cardboard. The embossing rollers 15 of this type have a corresponding number of embossing members 17 on their surface, with the embossing members 17 being evenly distributed across the circumference of the embossing rollers 15, in other words the angular distance between two adjacent embossing members 17 is in each case identical. An embossing roller 15 whose circumference corresponds to n-times the distance between two succeeding folds 18 in the web 1 of corrugated cardboard therefore comprises n embossing members 17 which are in each case arranged at an angular distance of 360°/n on the surface thereof.

The embossing members 17 are replaceable. This allows the distance between two succeeding folds 18 in the web 1 of corrugated cardboard to be adjusted easily, the distance just corresponding to the circumference of the embossing rollers 15.

Finally, the squeezing device 4 comprises an outlet portion 19 which is provided downstream of the inlet portion 12. In the outlet portion 19, outlet rollers 20 are arranged, the outlet rollers 20 comprising outlet roller axes which are parallel to the inlet roller axes. The outlet rollers 20 arranged below the web 1 of corrugated cardboard may be part of a transport unit 21 which may comprise carriers 22 for mounting the outlet rollers 20.

Downstream of the squeezing device 4, in other words downstream of the squeezing device 4 when seen in the transport direction 2, there is arranged a folding device 5. The folding device 5 comprises a guide device 23 which comprises an inlet region 24. The guide device 23 is in turn formed by two guide units 25 which are substantially identical and are arranged next to and at a distance to each other in a direction perpendicular to the transport direction 2. Each guide unit 25 is formed by a plurality of rigid frame parts 26 which are rigidly connected to each other. The frame parts 26 are arranged next to and at a distance to each other in a direction perpendicular to the transport direction 2. They are substantially identical and oriented vertically. The frame 11 is mounted to the outer frame parts 26.

The guide device 23 has a lifting portion 27 which adjoins the inlet region 24 in the transport direction 2. The lifting portion 27 is arranged at an angle relative to a horizontal and therefore extends in an oblique plane. It is arranged at an angle a relative to the horizontal. The angle a is between 2° and 20°, preferably between 5° and 15°. Most preferably, the angle a amounts to approximately 10°.

The guide device 23 further comprises a deposition portion 28 which adjoins the lifting portion 27 in the transport direction 2. The deposition portion 28 is formed in the shape of an arc. It is preferably formed in the shape of a circular arc which extends across an angular region of approximately 90° to 130°, preferably 100° to 120°, and most preferably forms an angle of 110°. A small region of the deposition portion 28 slopes upward when seen in the upstream direction. The remaining region of the deposition portion slopes downward when seen in the transport direction 2.

The guide device 23 further comprises a return portion 29 which adjoins the deposition portion 28 when seen in the downstream direction and the lifting portion when seen in the upward direction. The return portion 29 extends substantially below the lifting portion 27 and the deposition portion 28. It has a first return region 30 and a second inclined return region 31. The return region 30 adjoins the downstream end of the deposition portion 28 and is substantially horizontal while the return region 31 slopes upward from the return region 30 at an angle relative to the horizontal.

The design of the frame parts 26 of the guide device 23 corresponds to that of the portions 27, 28, 29. They are in each case circumferentially closed. The frame parts 26 of a guide unit 25 are rigidly connected to each other and combined in one piece by means of connection pieces 32. The connection pieces 32 also provide for a spaced arrangement of the individual frame parts 26 of a guide unit 25 relative to each other. Between these frame parts 26, there is in each case a horizontal distance which is preferably constant.

Between two adjacent frame parts 26 of a guide unit 25, there is arranged in each case one circulatory member 33 which is circumferentially closed and laterally guided by the corresponding frame parts 26. The circulatory members 33 are thus endless. They are bendable, in other words flexible. If each guide unit 25 is equipped with n frame parts 26, then each guide unit 25 is provided with n−1 circulatory members 33. The circulatory members 33 of a guide unit 25 are separated from each other by the frame parts 26. In this embodiment, each guide unit 25 is provided with five circulatory members 33.

The circulatory members 33 run along the frame parts 26. To this end, a guide unit 25 is provided with several guide members which are for example formed as rotatable rolls arranged between the individual frame parts 26 of a guide unit 25. The inlet region 24 is provided with inlet guide members 34. The inlet guide members 34 are disposed between the lifting portion 27 and the return portion 29. The inlet guide members 34 of a guide unit 25 have a common inlet guide member axis which is perpendicular to the transport direction 2. In the deposition portion 28, there is a multitude of deposition guide members 35 which are arranged on different deposition guide members axes which are perpendicular to the transport direction 2. The deposition guide members 35 of a guide unit 25 which are arranged on a deposition guide member axis are rotatable preferably independently of each other. Downstream of the deposition guide members 35, deflection members 36 are provided between the deposition portion 28 and the return portion 29. The deflection members 36 of a guide unit 25 are disposed on a deflection member axis which is perpendicular to the transport direction 2 and are rotatable preferably independently of each other. Between the return region 30 and the return region 31, there are additional guide members 37. The guide members 37 of a guide unit 25 are disposed on a common guide member axis which is perpendicular to the transport direction 2 and are rotatable preferably independently of each other. The circulatory members 33 are in each case guided around the outside of the guide members 34, 35, 36, 37 which determine the path of the circulatory members 33.

The circulatory members 33 are provided with several engagement members. The number of engagement members depends on the number of circulatory members 33. The number corresponds to the number of circulatory members 33 each guide unit 25 is provided with. If each guide unit 25 is provided with n circulatory members 33, then n engagement members are provided. Consequently, this embodiment is provided with a total of five engagement members. The engagement members have in each case an oblong shape. They are perpendicular to the transport direction 2 and are substantially parallel to each other.

The opposite longitudinal ends 43 of the engagement members are in each case mounted to the circulatory members 33 in such a way as to form a pair of circulatory members. The guide members, which are guided in the two guide units 25 between corresponding frame parts 26, form in each case one pair of circulatory members. For example, the first engagement member 38 is mounted to the two innermost circulatory members 33 of the guide units 25. These two circulatory members 33 are adjacent to the two innermost frame parts 26 of the guide units 25. The innermost frame parts 26 face each other. The engagement member 39 on the other hand is mounted to the two circulatory members 33 of the guide units 25 which are adjacent to the innermost circulatory members 33 of the guide units 25. The engagement member 40 is rigidly connected to the central circulatory members 33 of the guide units 25. The engagement member 42 is mounted to the outermost circulatory members 33 of the guide units 25. The outermost circulatory members 33 are adjacent to the outermost frame parts 26 of the guide units 25. The outermost frame parts 26 face away from each other. The engagement member 41 on the other hand is connected to the circulatory members 33 which are arranged between the outermost circulatory members 33 and the central circulatory members 33 of the guide units 25. The distance between the two innermost circulatory members 33 is smaller than the distance between the two outermost circulatory members 33. The circulatory members 33, which are in each case combined in such a way as to form a pair, are coupled to each other via the engagement members 38 to 42.

A drive device 44 is assigned to the inlet guide members 34 for rotating the inlet guide members 34. The drive device 44 comprises a plurality of drive belts 45 so as to ensure a synchronous drive of the circulatory members 33 which are combined in pairs. It is however conceivable as well to provide separate drive devices 44. The pairs of circulatory members are drivable or movable independently of each other.

The folding device 5 further comprises an oblong, rigid deposition support member 46 which is arranged between the guide units 25. The deposition support member 46 extends between the two innermost frame parts 26. The longitudinal ends of the deposition support member 46 are provided next to the transition between the return regions 30, 31 of the guide units 25. The deposition support member 46 is star-shaped. In this embodiment, it comprises three deposition support arms 47 which extend radially from a common center. A different number of deposition support arms 47 is conceivable as well. There may for example be provided two, four or five deposition support arms 47. The angular distance between the deposition support arms 47 is in each case identical. The deposition support member 46 is drivable for rotation by a corresponding drive and is perpendicular to the transport direction 2.

The stacking device 7 is disposed substantially below the return region 30. The separation device 6 is mounted to the top of the frame 10 of the stacking device 7. It comprises a separation knife 48 which is designed as a circular knife and is drivable for rotation via a separation knife drive 49. The separation knife drive 49 is displaceable in a direction perpendicular to the transport direction 2. To this end, the frame 10 is provided with corresponding guide rails 50 which extend horizontally along the top of the frame 10 in a direction perpendicular to the transport direction 2. The separation knife drive 49 may be displaced using a hydraulic member or an electric drive.

The separation device 6 further comprises a separation table 51 which is formed as a counter member and is also provided at the top of the frame 10. The separation table 51 comprises a penetration recess 52 at the front which extends along the entire width of the separation table 51 and is open towards the separation knife 48. The separation table 51 is horizontally displaceable. To this end, the separation table 51 is provided with a separation table drive 53 which is able to move the separation table 51 between a separation position and a non-separation position. In the separation position, the separation knife 48 projects into the penetration recess 52. In the non-separation position, the separation knife 48 and the penetration recess 52 are spaced from each other.

The stacking device 7 further comprises a stacking table 54 which is mounted in the frame 10 in such a way as to be vertically adjustable. The stacking table 54 comprises an upper support surface 55.

The following is a description of the functioning of the installation according to the invention. A web 1 of corrugated cardboard is produced in the corrugated cardboard production device 3 according to a method which is for example disclosed in DE 103 12 600 A1. To this end, one or several linerboards are joined to one or several corrugated sheets according to a method known to those skilled in the art in such a way as to form the web 1 of corrugated cardboard; details of this method are also set out in DE 43 05 148 A1. The endless web 1 of corrugated cardboard arriving from the corrugated cardboard production device 3 is then provided with embossings in the squeezing device 4. To this end, the web 1 of corrugated cardboard is passed through between the embossing rollers 15. After in each case one full revolution of the embossing rollers 15, in other words when the circumference thereof has rolled on the web 1 of corrugated cardboard exactly once, the two embossing members 17 meet, causing a fold 18 to be embossed into the region which is currently located between the embossing members 17. The embossing rollers 15 are driven and/or the embossing members 17 are arranged on the embossing rollers 15 in such a way as to be precisely matched to each other. The embossing members 17 may be designed in such a way as to produce corresponding perforations in the web 1 of corrugated cardboard. Even after passing through the squeezing device 4, the web 1 of corrugated cardboard is still continuous when seen in the transport direction 2. Downstream of the squeezing device 4, the web 1 of corrugated cardboard has a multitude of folds 18 which are spaced from each other. The folds 18 are parallel to each other and are perpendicular or substantially perpendicular to the transport direction 2.

From the squeezing device 2, the web 1 of corrugated cardboard, which is now provided with folds 18, is transported in the transport direction 2 to the folding device 5. Upstream of the folding device 5, there may be a deflection table 56 whose table top 57 slopes upward when seen in the transport direction 2. The table top 57 thus causes the web 1 of corrugated cardboard to be deflected upward, in other words vertically, from its original horizontal path. The web 1 of corrugated cardboard slides on top of the table top 57.

The web 1 of corrugated cardboard then reaches the folding device 5. The circulatory members 33 are continuously driven by the inlet guide members 34 which are driven for rotation. They are driven in such a way as to have a common direction of rotation. The direction of rotation of the circulatory members 33 substantially corresponds to the transport direction 2 in the region of the lifting portion 27. In the region of the return portion 29 on the other hand, the direction of rotation of the circulatory members 33 is substantially opposite to the transport direction 2. The engagement members 38 to 42 mounted to the circulatory members 33 are guided correspondingly. The circulatory members 33 may be accelerated or decelerated at all times, thus enabling the folding progress of the web 1 of corrugated cardboard to be influenced. In this case, a relative movement occurs between these accelerated or decelerated circulatory members 33.

The web 1 of corrugated cardboard enters the guide device 23 via the inlet region 24. The circulatory members 33 are driven by the drive device 44 or the inlet guide members 34, respectively, in such a way that in the lifting portion 27, one engagement member 38 to 42 comes into contact with the lower region of every second fold 18 at a particular instant when seen in the transport direction 2. In the lifting portion 27, the engagement members 38, 42 therefore engage with the web 1 of corrugated cardboard from below. Seen in the transport direction 2, they come into contact with every second fold 18 in the lifting portion 27 with a tolerance of no more than 10 cm, in particular of no more than 5 cm, in particular of no more than 3 cm. The engagement members 38 to 42 cause the web 1 of corrugated cardboard to be guided between the guide units 25 in individual sections; to this end, the guide units 25 are arranged at a corresponding distance from each other. The web 1 of corrugated cardboard is carried along by the engagement members 38 to 42.

In the lifting portion 27, the engagement members 38 to 42 cause the web 1 of corrugated cardboard to be lifted up further. The circulatory members 33 and the engagement members 38 to 42 gain height in the lifting portion 27. The same applies to the web 1 of corrugated cardboard which runs at an angle relative to the horizontal in the lifting portion 27.

Likewise, the web 1 of corrugated cardboard is also lifted up further by the engagement members 38 to 42 in the inlet region of the deposition portion 28. The circulatory members 33 take the same path. The engagement members 38 to 42 have reached their maximum height in a peak region of the guide device 23. In the peak region, the regions of the web 1 of corrugated cardboard which are adjacent to a fold 18 located there are oriented substantially vertically.

Downstream of a peak of the guide device 23, in other words in the deposition portion 28, the web 1 of corrugated cardboard is folded over. The circulatory members 33 lose height in the deposition portion 28. The same applies to the engagement members 38 to 42. In this portion, the circulatory members 33 and the engagement members 38 to 42 describe an arcuate path, causing the regions of the web 1 of corrugated cardboard which are adjacent to the respective fold 18 to further approach each other. At the end of the deposition portion 28, the regions which are adjacent to the respective fold 18 substantially abut each other and extend in the horizontal direction. At the downstream end of the deposition portion 28, the web 1 of corrugated cardboard has a height which is lower than the height of the web 1 of corrugated cardboard in the squeezing device 4.

Downstream of the deposition portion 28, in other words in the return region 30, the engagement members 38 to 42 come out of engagement with the folded web 1 of corrugated cardboard. They are then moved back to the lifting portion 27 via the return portion 29, thus ensuring a continuous circulation of the engagement members 38 to 42.

The folds 18 which are free, in other words which are not engaged by the engagement members 38 to 42, reach between the deposition support arms 47 so as to engage with the deposition support member 46. When seen in the transport direction 2, every second fold 18 is free. The fold edge regions of the web 1 of corrugated cardboard adjacent to these free folds 18 may abut the deposition support arms 47. In the region of the free folds 18, the deposition support member 46 defines a precise folding point for the web 1 of corrugated cardboard. At this point, folding of the web 1 of corrugated cardboard is assisted by the deposition support arms 47. The deposition support member 46 provides support to the free folds 18 while guiding the free folds 18 in the direction of the deposition portion 28.

The web 1 of corrugated cardboard which is folded along the folds 18 in the manner of a Leporello is then stacked in the stacking device 7 in such a way as to form a stack 58. The stack 58 is disposed on the support surface 55 of the stacking table 54. As the height of the stack 58 increases, the stacking table 54 is moved downwards.

The separation device 6 allows the folded web 1 of corrugated cardboard to be cut or separated in a direction transverse to the transport direction 2. To this end, the separation knife 48 needs to be set in rotation by means of the separation knife drive 49 before being inserted into the web 1 of corrugated cardboard. To this end, the separation table 51 needs to be moved from the non-separation position to the separation position, allowing the rotating separation knife 48 to cut through the web 1 of corrugated cardboard so as to penetrate into the penetration recess 52 of the separation table 51 which thus forms a counter member for the separation knife 48. The separation knife 48 then needs to be moved along a fold 18, in other words across the entire width of the web 1 of corrugated cardboard.

In the event of a change in size which also results in a change of distance between the folds 18, the distance between the engagement members 38 to 42 needs to be adjusted as well. To this end, the pairs of circulatory members need to be actuated individually, causing relative movements to occur between the pairs of circulatory members when the change in size is performed. The change in size may be performed when the installation is in operation. The folding device 5 may be adjusted to the changed distance between the folds 18 automatically. The engagement members 38 to 42 are always displaced relative to each other in such a way that a certain distance is maintained, allowing the folding process to be influenced continuously via the circular path of the engagement members 38 to 42. In the event of a change in size, this adjustment is more extreme, in other words the distance between the engagement members 38 to 42 is on the one hand adapted to the new size as well as to the respective folding progress on the other which depends on the position of the engagement member 38 to 42 along its circular path.

What is claimed is:

1. An installation for folding and stacking an endless web of corrugated cardboard, the installation comprising at least one corrugated cardboard production device for producing an endless web of corrugated cardboard;

a squeezing device which is arranged downstream of the at least one corrugated cardboard production device for embossing folds into the web of corrugated cardboard;

a folding device which is arranged downstream of the at least one squeezing device for folding the web of corrugated cardboard along the folds, with the folding device comprising:

a first engagement member which is guided for displacement so as to carry along the web of corrugated cardboard in the region of a first fold; and at least one second engagement member which is guided for displacement independently of the first engagement member so as to carry along the web of corrugated cardboard in the region of a second fold, said second fold being located on the web in a position that is upstream of the first fold; and a stacking device which is arranged downstream of the folding device for stacking the web of corrugated cardboard, which has been folded along the folds, in such a way as to form stacks, wherein a guide device guides at least one first circulating, drivable, endless circulatory member to which the first engagement member is mounted, wherein the guide device guides at least one second circulating, drivable, endless circulatory member to which the second engagement member is mounted, wherein the first circulatory member and the at least second circulatory member are drivable independently of each other, and wherein a drive device accelerates or decelerates the circulatory members at all times, to influence the folding progress of the web of corrugated cardboard, wherein, when the circulatory members are accelerating or decelerating, a relative movement occurs between these accelerated or decelerated circulatory members.

2. An installation according to claim 1, wherein the folding device comprises a guide device for guiding the engagement members, with the guide device defining a movement path for the engagement members.

3. An installation according to claim 2, wherein the movement path defined by the guide device is a closed-loop movement path.

4. An installation according to claim 2, wherein the circulatory members are arranged next to one another in the guide device.

5. An installation according to claim 2, wherein the guide device comprises at least one upwardly sloping lifting portion in which the circulatory members are guided upward for lifting the web of corrugated cardboard.

6. An installation according to claim 5, wherein downstream of the lifting portion, the guide device comprises at least one downwardly sloping deposition portion in which the circulatory members are guided downwards for folded deposition of the web of corrugated cardboard.

7. An installation according to claim 6, wherein the at least one deposition portion describes the shape of an arc.

8. An installation according to claim 6, wherein downstream of the deposition portion, the guide device comprises a return portion for returning the engagement members, wherein the return portion adjoins the inlet end of the lifting portion.

9. An installation according to claim 1, wherein the folding device comprises at least one deposition support member which is drivable for rotation and supports the deposition of the folded web of corrugated cardboard, with the at least one deposition support member comprising at least two deposition support arms for interaction with unguided fold edge regions of the web of corrugated cardboard.

10. An installation according to claim 9, wherein the at least one deposition support member is in the shape of a star.

11. An installation according to claim 1, wherein the stacking device comprises a height-adjustable stacking table for carrying the stack.

12. An installation according to claim 1, comprising a separation device for separating the web of corrugated cardboard, with the separation device being arranged between the folding device and the stacking device.

13. An installation according to claim 12, wherein the separation device comprises at least one separation knife and at least one counter member for interaction with the at least one separation knife, with the at least one counter member being provided with at least one penetration recess for at least partially receiving the at least one separation knife.

14. An installation according to claim 13, wherein the separation knife and the counter member are movable towards each other in order to separate the web of corrugated cardboard, wherein the counter element is provided with a drive which is able to move the counter member between a separation position and a non-separation position, wherein, in the separation position, the separation knife projects into the penetration recess and, in the non-separation position, the separation knife and the penetration recess are spaced from each other.

15. An installation for folding and stacking an endless web of corrugated cardboard, the installation comprising at least one corrugated cardboard production device for producing an endless web of corrugated cardboard;

squeezing device which is arranged downstream of the at least one corrugated cardboard production device for embossing folds into the web of corrugated cardboard;

a folding device which is arranged downstream of the at least one squeezing device for folding the web of corrugated cardboard along the folds, with the folding device comprising:

a first engagement member which is guided for displacement so as to carry along the web of corrugated cardboard in the region of a first fold; and at least one second engagement member which is guided for displacement independently of the first engagement member so as to carry along the web of corrugated cardboard in the region of a second fold, said second fold being located on the web in a position that is upstream of the first fold; and a stacking device which is arranged downstream of the folding device for stacking the web of corrugated cardboard, which has been folded along the folds, in such a way as to form stacks, wherein a guide device guides at least one first circulating, drivable circulatory member to which the first engagement member is mounted, wherein the guide device guides at least one second circulating, drivable circulatory member to which the second engagement member is mounted, wherein the first circulatory member and the at least second circulatory member are drivable independently of each other, wherein the guide device is formed by two guide units which are arranged next to and at a distance to each other in a direction perpendicular to a transport direction of the web of corrugated cardboard, wherein each guide unit is provided with the circulatory members which are arranged next to and at a distance to each other in a direction perpendicular to the transport direction, wherein the two guide units are coupled to each other via the engagement members, and wherein longitudinal ends of the engagement members are in each case mounted to the circulatory members of the two guide units in such a way as to form a pair of circulatory members, wherein each pair of circulatory members carries one engagement member.

16. A method for folding and stacking an endless web of corrugated cardboard, the method comprising the following steps:

producing an endless web of corrugated cardboard;

embossing folds into the web of corrugated cardboard;

folding the web of corrugated cardboard along the folds by means of a first engagement member which is guided for displacement so as to carry along the web of corrugated cardboard in the region of a first fold, and at least one second engagement member which is guided for displacement independently of the first engagement member so as to carry along the web of corrugated cardboard in the region of a second fold, said second fold being formed in the web upstream of the first fold; and stacking of the folded web of corrugated cardboard in such a way that stacks are formed, wherein the engagement members are always displaced relative to each other, allowing the folding process to be influenced continuously via the path of the engagement members, wherein the guide device is formed by two guide units which are arranged next to and at a distance to each other in a direction perpendicular to a transport direction of the web of corrugated cardboard, wherein each guide unit is provided with circulatory members which are arranged next to and at a distance to each other in a direction perpendicular to the transport direction, wherein the two guide units are coupled to each other via the engagement members, and wherein longitudinal ends of the engagement members are in each case mounted to the circulatory members of the two guide units in such a way as to form a pair of circulatory members, each pair of circulatory members carries one engagement member, and wherein the circulatory members are accelerated or decelerated at all times, thus influencing the folding progress of the web of corrugated cardboard, wherein, in the case of accelerating or decelerating of the circulatory members, a relative movement occurs between these accelerated or decelerated circulatory members.

* * * * *